US008550278B2

(12) United States Patent
Pittrich

(10) Patent No.: US 8,550,278 B2
(45) Date of Patent: Oct. 8, 2013

(54) FOLDING BOX

(75) Inventor: Gerhard Pittrich, Linz (AT)

(73) Assignee: Leisch Beratungs- und Beteiligungs-GmbH, Linz (AT)

( * ) Notice: Subject to any disclaimer, the term of this patent is extended or adjusted under 35 U.S.C. 154(b) by 21 days.

(21) Appl. No.: 13/138,412

(22) PCT Filed: Feb. 11, 2010

(86) PCT No.: PCT/AT2010/000040

§ 371 (c)(1),
(2), (4) Date: Oct. 12, 2011

(87) PCT Pub. No.: WO2010/091447

PCT Pub. Date: Aug. 19, 2010

(65) Prior Publication Data

US 2012/0024846 A1 Feb. 2, 2012

(30) Foreign Application Priority Data

Feb. 12, 2009 (AT) ..... A 232/2009

(51) Int. Cl.
*B65D 6/16* (2006.01)
*B65D 8/14* (2006.01)
*B65D 69/00* (2006.01)

(52) U.S. Cl.
USPC ..... 220/7; 220/6; 220/666; 206/577

(58) Field of Classification Search
USPC ..... 220/6, 7
See application file for complete search history.

(56) References Cited

U.S. PATENT DOCUMENTS

| | | | | |
|---|---|---|---|---|
| 2,799,423 | A | 7/1957 | Kaye | |
| 6,877,628 | B2 * | 4/2005 | Nesting | 220/7 |
| 2007/0125779 | A1 | 6/2007 | Cope | |

FOREIGN PATENT DOCUMENTS

| | | |
|---|---|---|
| EP | 0 785 142 | 7/1997 |
| EP | 1 785 360 | 5/2007 |
| WO | WO 00/66440 | 11/2000 |
| WO | WO 00/68099 | 11/2000 |
| WO | WO 2006/081737 | 8/2006 |

OTHER PUBLICATIONS

International Search Report of PCT/AT2010/000040, Jun. 21, 2010.

* cited by examiner

*Primary Examiner* — Anthony Stashick
*Assistant Examiner* — Jennifer Castriotta
(74) *Attorney, Agent, or Firm* — Collard & Roe, P.C.

(57) ABSTRACT

The invention relates to a folding box (1), comprising a base and first and second side walls (2, 3) pivotably connected to the base which, together with the base, form a box open at the top in a folded open state, as well as at least one retaining element (4) disposed on a first side wall (2) and at least one pin (5) mounted so as to be rotatable on a second side wall (3), and the at least one pin (5) has a cross-section that is not circular on at least one pin end (5*a*, 5*b*) and the at least one pin end (5*a*, 5*b*) locks the first to the second side wall (2, 3) by means of the retaining element (4) in a first rotational position and unlocks said side walls (2, 3) in a second rotational position.

5 Claims, 7 Drawing Sheets

FOLDING BOX

CROSS REFERENCE TO RELATED APPLICATIONS

Figure 2A:
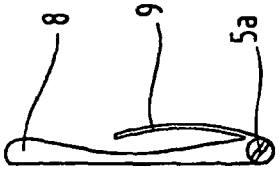

This application is the National Stage of PCT/AT2010/000040 filed on Feb. 11, 2010, which claims priority under 35 U.S.C. §119 of Austrian Application No. A 232/2009 filed on Feb. 12, 2009, the disclosure of which is incorporated by reference. The international application under PCT article 21(2) was not published in English.

The invention relates to a folding box with a base, first and second side walls pivotably connected to the base which, together with the base, form a box open at the top in a folded open state, at least one retaining element disposed on a first side wall and at least one pin mounted so as to be rotatable on a second side wall.

Folding boxes are practical aids for transporting objects because they form a box or crate which is open at the top in the folded open state and are flat in a folded down state and are therefore easy to store. This represents a significant advantage over fixed boxes. However, the use of folding boxes is limited or even prevented as a rule due to reduced strength. Furthermore, the known locking mechanisms which lock the side walls relative to one another and are intended to prevent the box from collapsing are often unreliable or of a very complex design.

For example, a plastic box with fold-up side walls is known from patent specification EP 0 785 142 A1, and two oppositely lying side walls have pins protruding out from the side of them which locate in grooves in the adjacent side walls and latch in an end position. The disadvantage in this instance is that the box can be folded down relatively easily because a sufficiently high pressure expended on the side walls incorporating the pins is enough to unlock the side walls. If a fully loaded box inadvertently collapses, the objects contained in it can fall out, which defeats the purpose of such a box.

Patent specification WO 00/68099 also discloses a portable container, likewise made from plastic, comprising an essentially rectangular base and two pairs of pivotably mounted side walls. Bolts are provided on two of the side walls as a means of locking the side walls. The bolts can be slid between an unlocked position and a locked position. In the latter, the bolts protrude out from the side wall and locate in a recess in the adjacent side wall. Due to the sliding mechanism of the bolts, the container is technically of a relatively complex design. For many users and applications, such a box is therefore rather basic and simply too expensive.

Accordingly, the objective of the invention is to propose a folding box which is better protected against being inadvertently folded down.

This objective is achieved by the invention by means of a folding box as defined in claim 1, namely a folding box comprising

- a base,
- first and second side walls pivotably connected to the base which, together with the base, form a box open at the top in a folded open state,
- at least one retaining element disposed on a first side wall,
- at least one pin mounted so as to be rotatable on a second side wall, and the at least one pin has a cross-section that is not circular on at least one pin end and the at least one pin end locks the first to the second side wall by means of the at least one retaining element in a first rotational position and unlocks said side walls in a second rotational position.

For the purpose of the invention, therefore, a non-circular, rotatable pin end on a side wall co-operates with a retaining element on an adjacent side wall so that the two walls are locked when the pin end is in a first rotational position and are unlocked in a second direction of rotation. This immediately results in several advantages. For example, the folding box is secured to prevent it from inadvertently folding down because folding it down requires a multistage motion sequence (unlocking by means of a first movement and folding down by means of a second movement). Moreover, it is therefore possible to use relatively simple and yet robust locking elements for the folding box because the rotary bearing of the pin is easier to operate than a bearing which permits a longitudinal movement of locking elements. For example, a bearing (e.g. pin of metal, bearing shell of plastic) can be designed so that it is intentionally tight in the state in which it is supplied because the pin and the bearing grind in during operation and thus produce an optimum seating of the parts over the course of time. This is made possible due to the fact that in the longitudinal direction, the same point of the pin is always in contact with the same point of the bearing. This is a major advantage over a slide bearing of the type known from the prior art because the rod-shaped locking elements often become bent—as inadvertently can happen all too easily unfortunately—thereby resulting in only a very loose bearing for the locking elements. As proposed by the invention, on the other hand, what is perceived by the user to be a good quality bearing because it sits tightly can be used but one which is based on simple means. The solution proposed by the invention—if the pin is of a continuous design—is able to operate with only two bearings, whereas the solutions known from the prior art require at least four bearing points for the sliding lock elements. Finally, sliding lock elements have a tendency to jam, for example when stubborn dirt or irregularities in the material make the movement through a bearing more difficult or prevent it at all. This phenomenon is largely unknown in the case of rotary bearings. The invention is therefore simpler, more reliable and can be produced with high quality but simpler means than is the case with solutions known from the prior art.

Advantageous embodiments and features of the invention are defined in the dependent claims and in the description given below with reference to the drawings.

It is of advantage if the at least one pin end has a cross-section selected from the group: rectangular with rounded corners, S-shaped, oval, ellipsoid, hook-shaped or a flattened circular cross-section. These cross-sections can be produced relatively easily and at the same time offer a very efficient locking function.

It is of particular advantage if the at least one pin is rotated into the first rotational position automatically with the aid of a spring. With this variant, therefore, the pin is disposed in the locked position by default. This counteracts any unintentional unlocking—because it would be necessary to overcome a spring force to do this. In this respect, it would be possible to use all types of torsion springs, leaf springs as well as coil-shaped tension and compression springs, and the force generated by a leaf or coil spring can be converted into a torque using appropriate means if necessary (levers and such like).

It is also of particular advantage if the at least one pin is automatically rotated into the second rotational position as the second side wall is folded open. In this variant of the invention, the pin moves into the unlocked position of its own accord as the box is folded open, in other words due to the pivoting movement of the side wall, so that the side walls can be pivoted into their end positions without the need for further actions.

Finally, it is of particular advantage if the at least one pin is automatically rotated into the first rotational position by means of the spring when the second side wall assumes the end position. This variant of the invention represents a combination of the two embodiments described above. On the one hand, the side walls are folded open into their end position without any special motion sequence (i.e. without having to be deliberately unlocked) and on the other hand, the side walls are automatically locked by the spring as soon as they have assumed their end position. Once the box has been folded completely open, therefore, it can no longer be unintentionally folded down. The actions needed by the user to operate a folding box reliably are therefore reduced to a minimum.

It is also of advantage if the at least one pin can be rotated into the first and/or second rotational position with the aid of a handle. Since it can be awkward to rotate the pin without some other aid under certain circumstances, a handle is provided on the pin in this embodiment of the invention to make it easy to rotate it.

The designs and features of the invention described above may be used in any combination.

To provide a clearer understanding of the invention, it will be described in more detail below with reference to the appended drawings.

Figure 5:
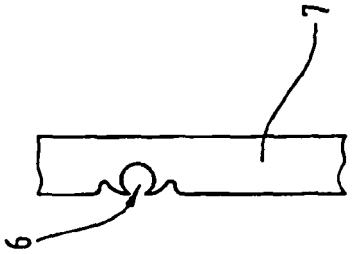
Figure 1:
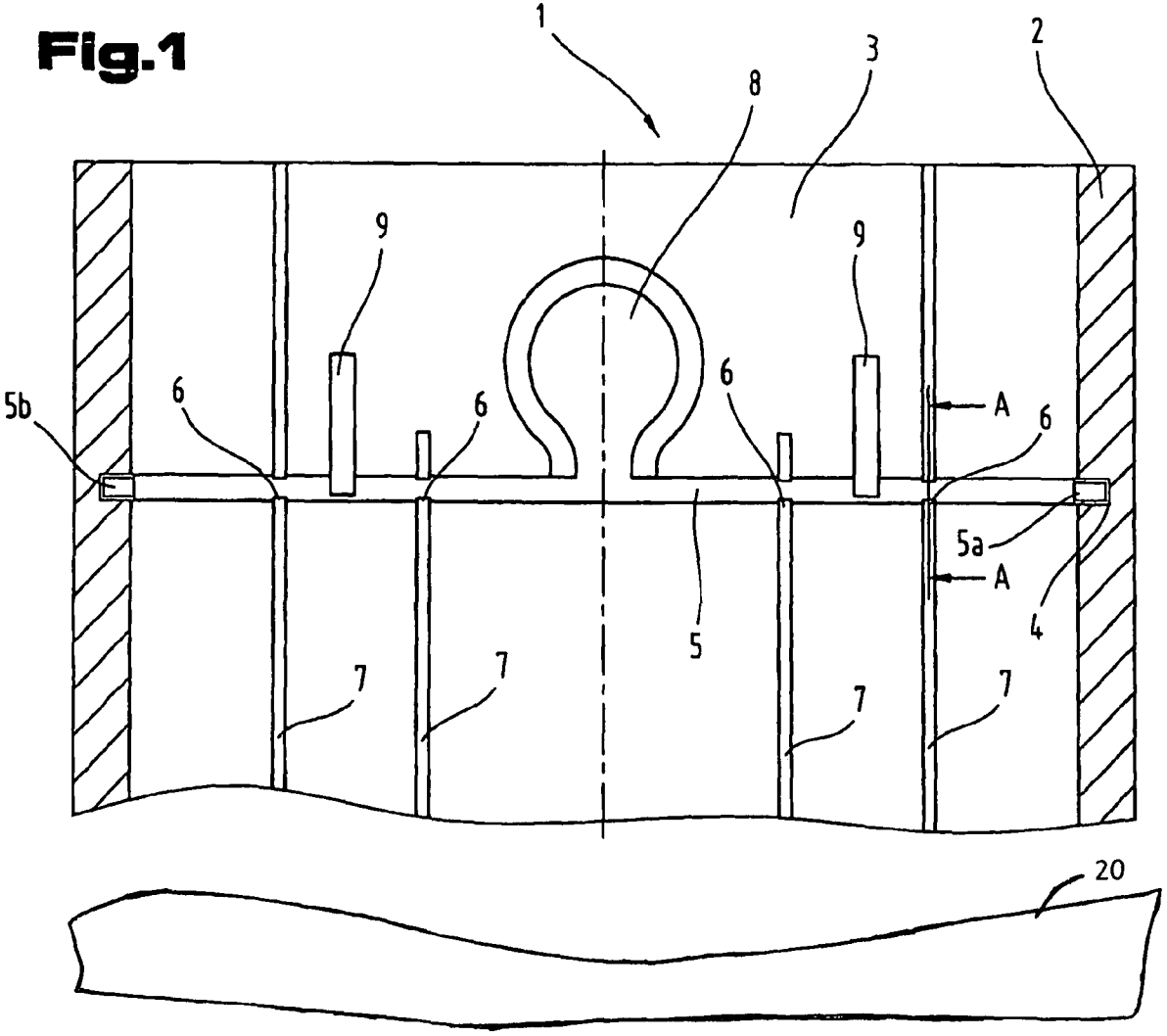
Figure 2C:
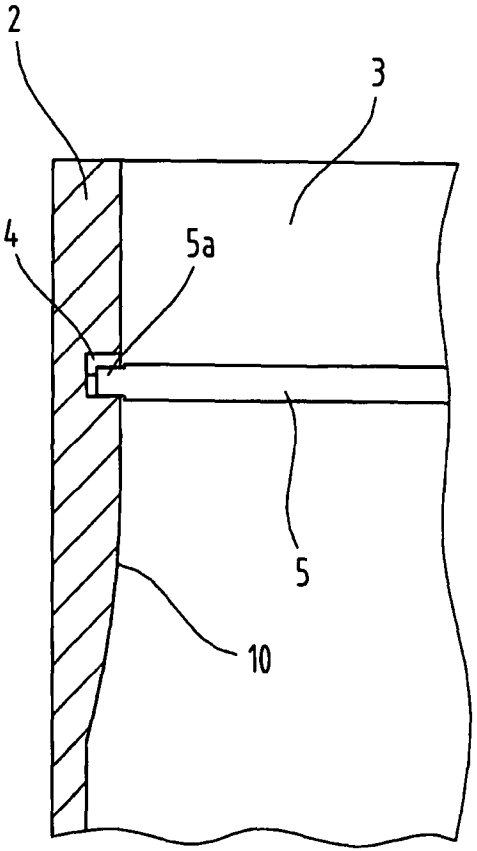
Figure 2B:
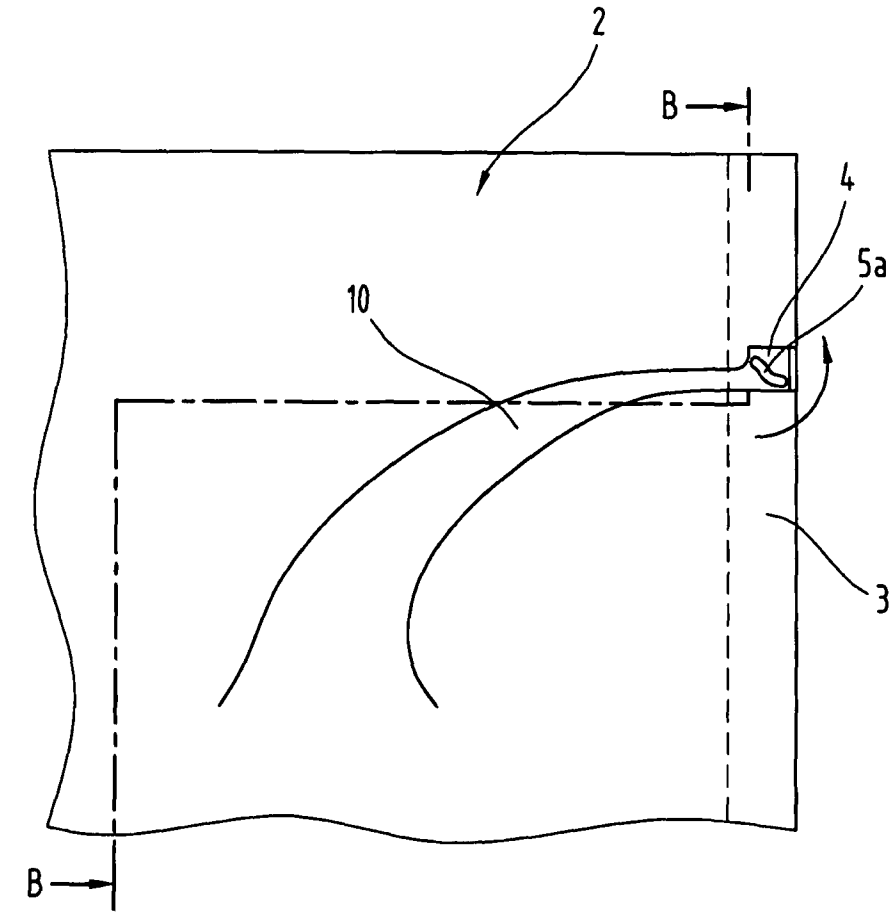
Figure 3A:
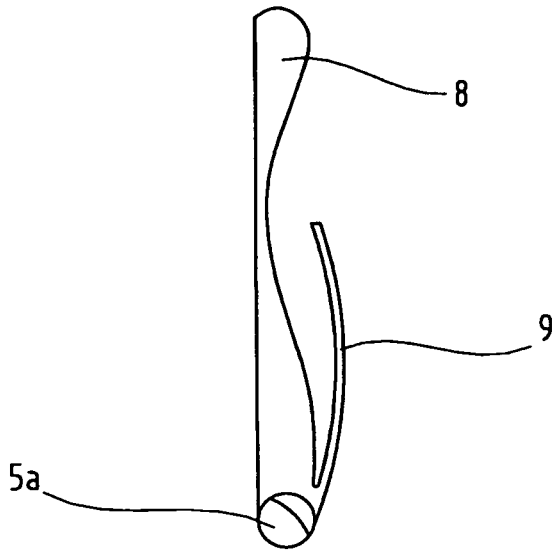
Figure 4A:
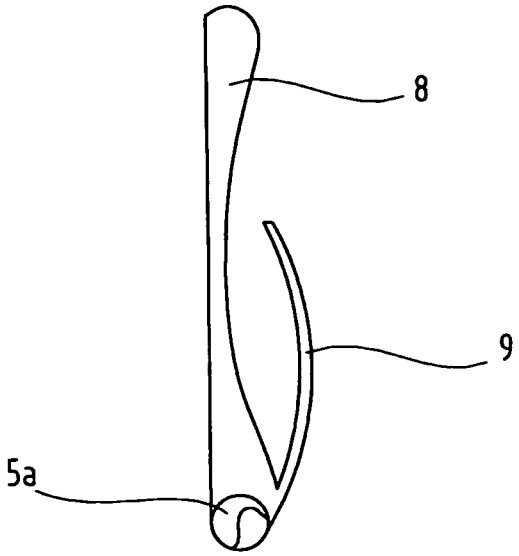
Figure 3C:
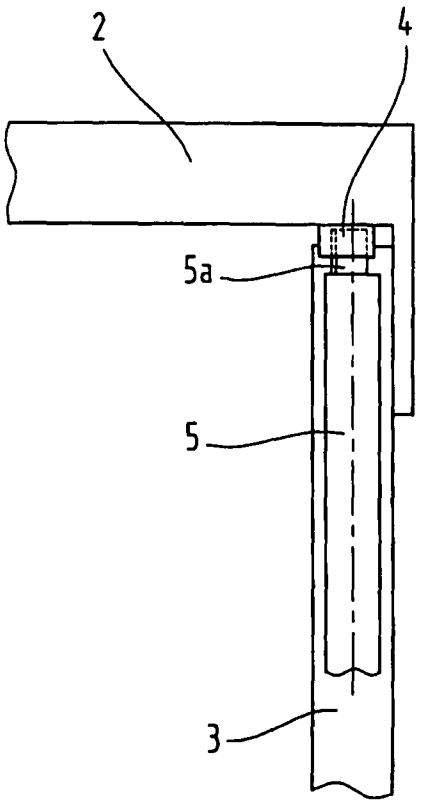
Figure 3B:
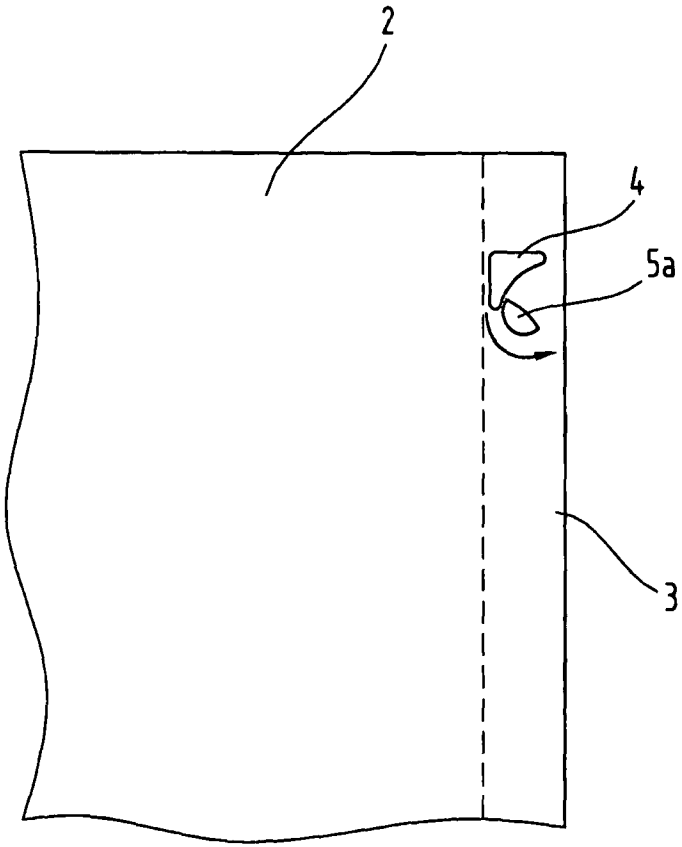
Figure 4C:
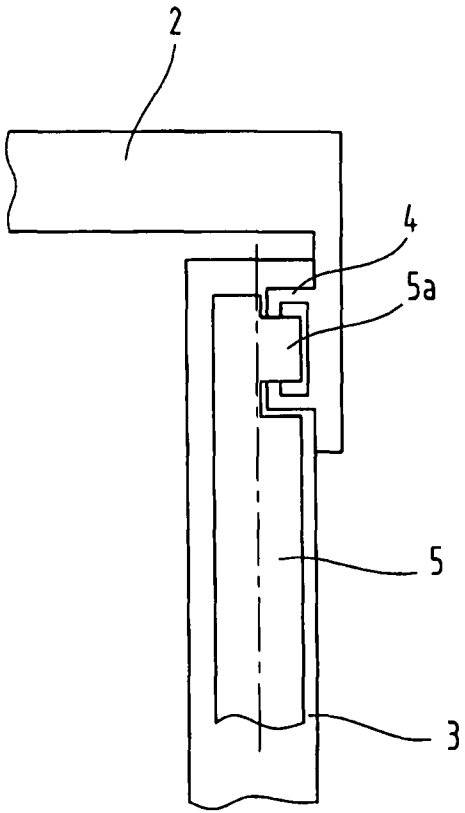
Figure 4B:
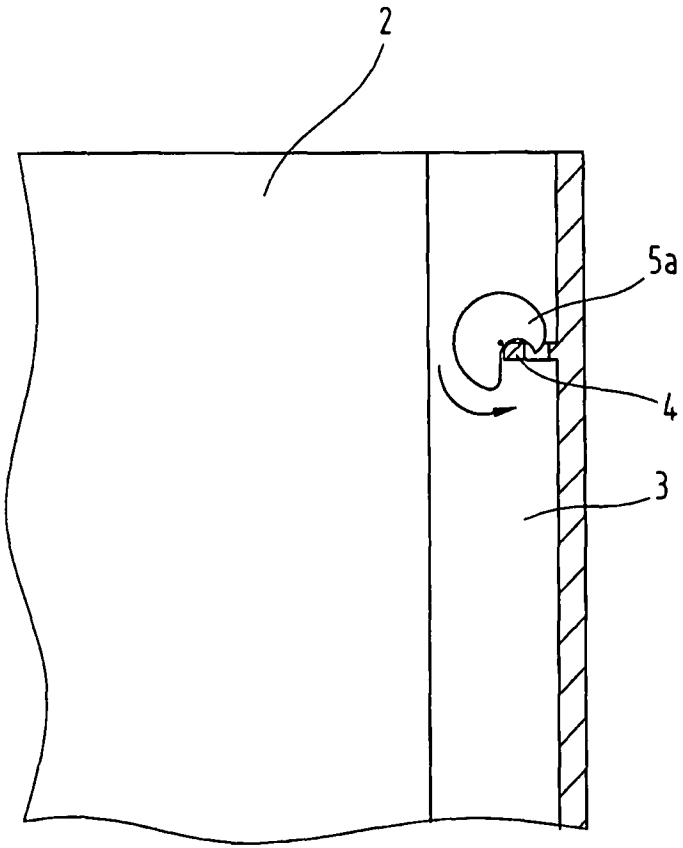
Figure 6:
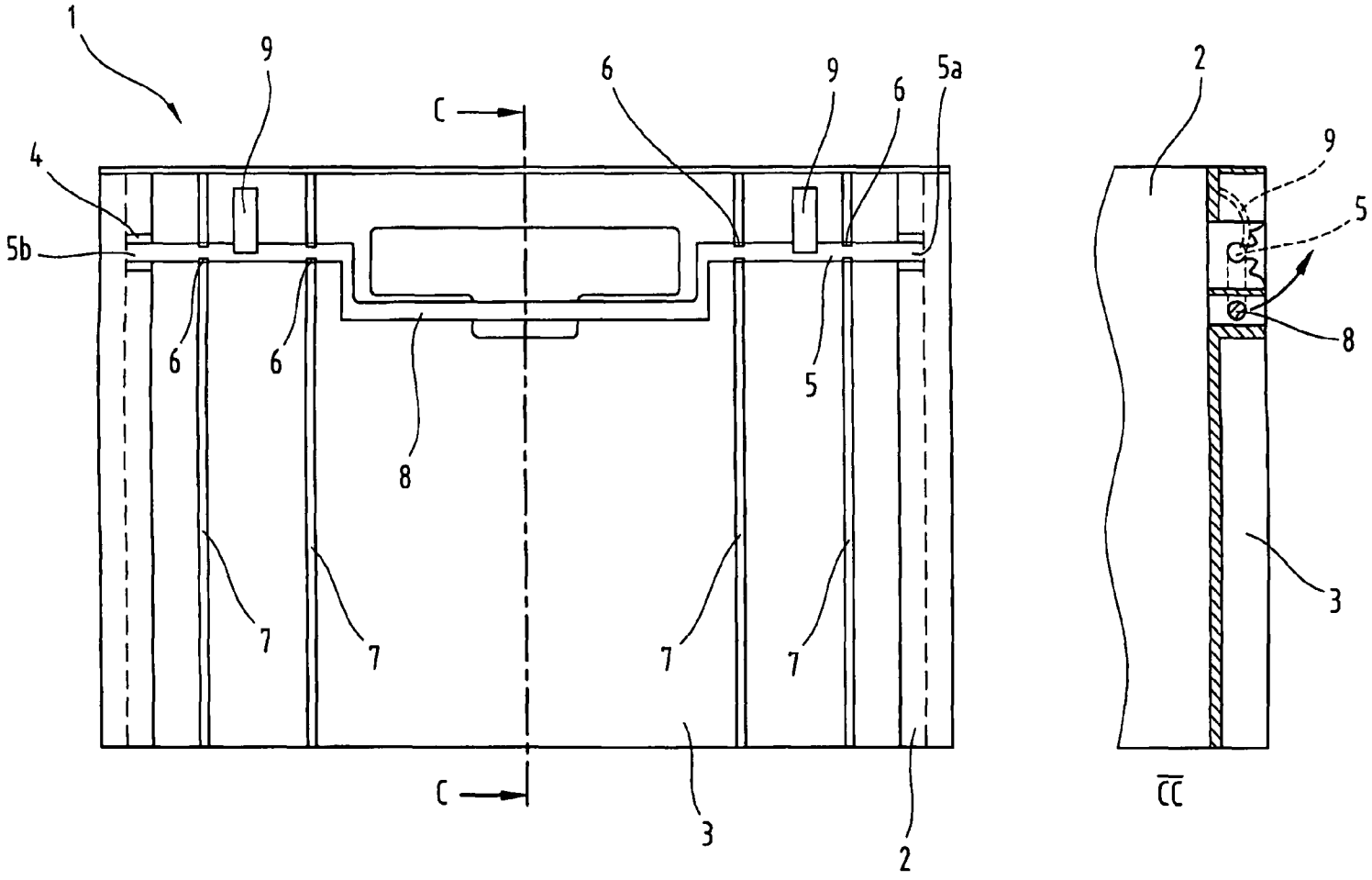
Figure 8:
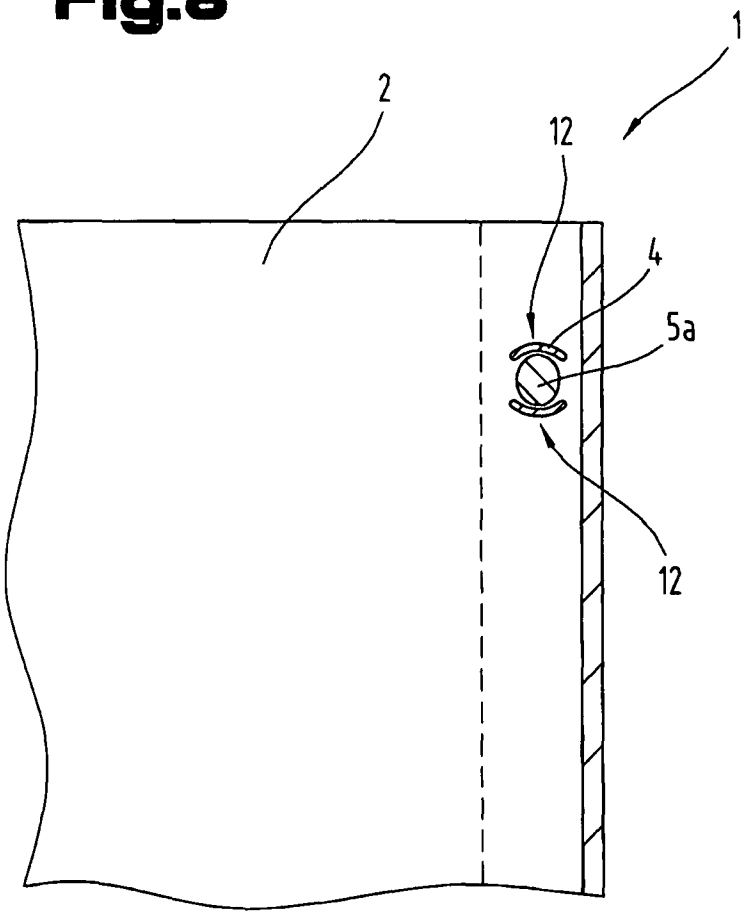
Figure 7:
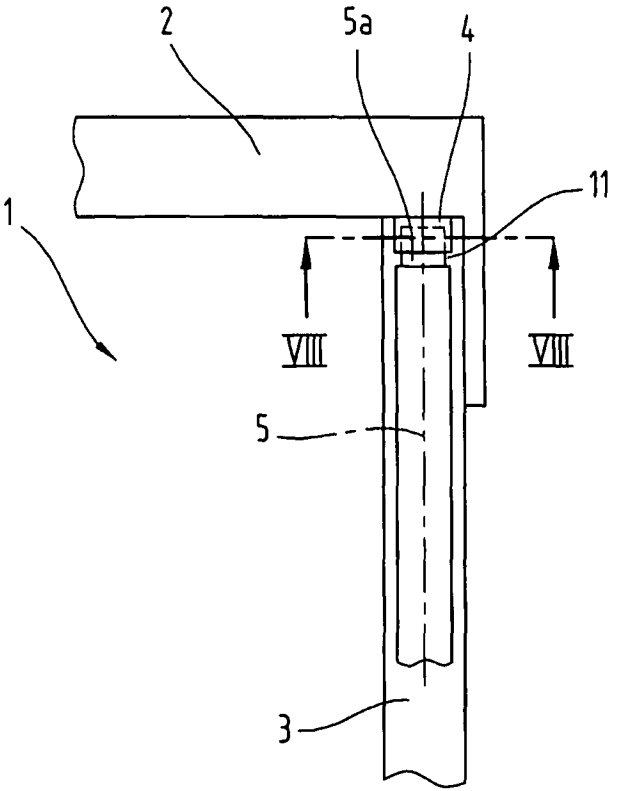

These are highly schematic, simplified diagrams illustrating the following:

FIG. 1 a side view of a folding box proposed by the invention;

FIG. 2*a* a first, S-shaped variant of a pin end;

FIG. 2*b* a detail illustrating how the first variant of the pin end co-operates with a retaining element on the first side wall;

FIG. 2*c* the detail from FIG. 2*b* but from a different direction;

FIG. 3*a* a second variant of a pin end with a flattened circular cross-section;

FIG. 3*b* a detail illustrating how the second variant of the pin end co-operates with a retaining element on the first side wall;

FIG. 3*c* the detail from FIG. 3*b* but viewed from above;

FIG. 4*a* a third variant of a pin end with a hook-shaped cross-section;

FIG. 4*b* a detail illustrating how the third variant of the pin end co-operates with a retaining element on the first side wall;

FIG. 4*c* the detail from FIG. 4*b* but viewed from above;

FIG. 5 a bearing shell for accommodating the pin;

FIG. 6 a variant of a lever for rotating the pin;

FIG. 7 a detail from an embodiment with an elliptical pin end seen in plan view;

FIG. 8 a side view of the embodiment illustrated in FIG. 7 along section VIII-VIII indicated in FIG. 7.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described. Individual features or combinations of features from the different embodiments illustrated and described may be construed as independent inventive solutions or solutions proposed by the invention in their own right.

The embodiments illustrated as examples represent possible variants of the folding box proposed by the invention and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

FIG. 1 illustrates an embodiment of a folding box 1 proposed by the invention, with a base 20, first and second side walls 2 and 3 pivotably connected to the base 20 and retaining elements 4 disposed on the first side walls 2. A pin 5 with two pin ends 5*a* and 5*b* is rotatably mounted in bearing shells 6 on the second side wall 3 and the bearing shells 6 may be integrated in reinforcing ribs 7. Finally, a lever 8 and two leaf springs 9 are disposed on the pin 5.

FIGS. 2*a* to 2*c* illustrate a first embodiment of the invention. FIG. 2*a* shows a side view of the pin 5 with the first pin end 5*a*, the lever 8 and the leaf springs 9. In this variant of the invention, the pin ends 5*a* and 5*b* are of an S-shaped design.

FIG. 2*b* illustrates how the pin end 5*a* co-operates with the retaining element 4. The pin end 5*a* is illustrated in the first rotational position in which the side walls 2 and 3 are locked. By rotating it in the counter-clockwise direction (indicated by an arrow), the pin end 5*a* can be moved into a second rotational position in which the pin end 5*a* is released from the retaining element 4 so that the side walls 2 and 3 can be pivoted in the direction towards the base of the folding box 1. This rotation is achieved by operating the lever 8 against the spring force of the leaf springs 9. When the second side wall 3 is then pivoted in the direction towards the base, the pin end 5*a*—having let go of the lever 8 again—moves slowly through the guiding gap back into the first rotational position again. With this type of lever, the unlocking action is obtained by pushing the lever 8 inwards. The leaf springs 9 lie against the external face of the second side wall 3 and thus generate a return force. It would naturally also be conceivable to opt for an embodiment in mirror image in which the lever 8 is pushed outwards.

When the side wall 2 is folded upright, the pin end 5*a* is moved slowly through the narrowing guide gap 10 into the second rotational position, namely the unlocked position. Once the side wall 2 has been folded completely upright, the pin end 5*a* then slips into the retaining element 4 where it assumes the first rotational position or locked position due to the spring force of the leaf springs 9. Locking therefore takes place automatically as the second side wall 3 is folded upright into its end position, whereas unlocking is obtained by operating the lever 8 against the spring force of the leaf springs 9. Any unintentional opening of the folding box 1 can therefore be more or less ruled out without losing convenience when folding the side walls 2 and 3 upright.

FIG. 2*c*, finally, shows a view of the variant illustrated in FIG. 2*b* along the first side wall 2 (see also section BB in FIG. 2*b*). The shape of the guide gap 10 and its boundary walls, which are flatter in the initial region and higher in the end region, are readily visible here. Due to the shape of the boundary walls of the guide gap 10 and the relatively large width of them at the start, the pin ends 5*a* and 5*b* slip particularly efficiently into the co-operating guide gaps 10 when the second side walls 3 is folded upright.

FIGS. 3*a* to 3*c* illustrate a second embodiment of the invention. FIG. 3*a* shows a side view of the pin 5 with the pin end 5*a*, the lever 8 and the leaf springs 9. In this variant of the invention, the pin ends 5*a* and 5*b* are provided in a shape with a flattened circular cross-section.

FIG. 3*b* illustrates how the pin end 5*a* co-operates with the retaining element 4. The pin end 5*a* is illustrated in the first rotational position in which the side walls 2 and 3 are locked. By rotating it in the counter-clockwise direction (indicated by an arrow), the pin end 5*b* can be moved into a second rotational position in which the pin end 5*a* is released from the retaining element 4 so that the side walls 2 and 3 can be pivoted in the direction towards the base of the folding box 1. This rotation takes place when the lever 8 is operated against the spring force of the leaf springs 9. When the second side wall 3 is then pivoted in the direction towards the base, the pin end 5*b* passes through the retaining elements 4 and is then rotated back into the first rotational position. As the second side wall 3 is folded upright, the pin end 5*a* is automatically rotated into the second rotational position due to the force acting eccentrically between the pin end 5*a* and retaining element 4 as soon as it hits the retaining element 4. As soon as the second side wall 3 has assumed its end position, however, the pin ends 5*a* and 5*b* are rotated by the leaf springs 9 into their first rotational position and then lock the side walls 2 and 3 with the aid of the retaining elements 4.

FIG. 3*c*, finally, shows a plan view of a corner of the folding box 1 in which the first side wall 2 is shown with the retaining element 4 and the second side wall 3 with the pin 5. This provides a clear illustration of how the pin end 5*b* co-operates with the retaining element 4.

FIGS. 4*a* to 4*c* illustrate a third embodiment of the invention. FIG. 4*a* shows a side view of the pin 5 with the pin end 5*a*, the lever 8 and the leaf springs 9. In this variant of the invention, the pin ends 5*a* and 5*b* are of a hook-shaped design.

FIG. 4*b* illustrates how the pin end 5*a* co-operates with the retaining element 4. The pin end 5*b* is illustrated in the first rotational position in which the side walls 2 and 3 are locked. By rotating it in the counter-clockwise direction (indicated by an arrow), the pin end 5*b* can be moved into a second rotational position in which the pin end 5*b* is released from the retaining element 4 so that the side walls 2 and 3 can be pivoted in the direction towards the base of the folding box 1. This rotation is achieved by operating the lever 8 against the spring force of the leaf springs 9. When the second side wall 3 is then pivoted in the direction towards the base, the pin end 5*b* passes through the retaining element 4 and then rotates back into the first rotational position. When the second side wall 3 is folded upright, the pin end 5*a* is turned by the retaining element 4 into the second rotational position in the same way as in the example described above and once the second side wall 3 has been folded completely upright is rotated into the first rotational position by means of the leaf springs 9.

FIG. 4*c*, finally, shows a plan view of a corner of the folding box 1, in which the first side wall 2 is illustrated with the retaining element 4 and the second side wall 3 with the pin 5. It is clearly illustrated how the pin end 5*a* co-operates with the retaining element 4.

In all of the described variants of the invention, the bearing of the pin 5 may be provided in an arrangement in which the bearing shells 6 are integrated in reinforcing ribs 7 of the second side wall 3. FIG. 5 illustrates a part of a reinforcing rib 7 in which a bearing shell 6 is disposed (see also section AA in FIG. 1). The bearing shell 6 advantageously comprises slightly more than a half-circle so that the pin 5 can be simply clipped in when the folding box 1 is being assembled. Cuts are advantageously provided next to the bearing shell 6, enabling the bearing shell 6 to be biased as it is clipped in.

FIG. 6, finally, is a side view and a section CC of a folding box 1 with a variant of a pin 5 that is not continuous but one where the lever 8 or pin 5 is split in the middle in particular, namely the lever 8 or pin 5 is provided with a downwardly extending shoulder in the middle region. The lever 8 and the pin 5 may be manufactured in a single piece or alternatively may comprise several pieces. This lever 8, which is designed to pivot underneath the handle of the folding box 1, may be used in all the described variants of the invention. The lever 8 is folded outwards in order to release it. The leaf springs 9 lie on the external face of the second side wall 3 and therefore generate a return force. Naturally, it would also be conceivable to opt for a design in reverse mirror image, in which case the lever 8 is pushed inwards and the leaf springs 9 lie on the internal face.

FIGS. 7 and 8 illustrate a detail of another embodiment of the invention, which is different from that illustrated in FIG. 1 and which is different essentially only due to a different design of the pin end 5*a* and retaining elements 4, respectively in a plan view and side view. Accordingly, FIG. 7 illustrates a plan view of a corner of the folding box 1, in which the first side wall 2 is shown with the retaining element 4 and the second side wall 3 is shown with the pin 5. It may be seen how the pin end 5*a* co-operates with the retaining element 4.

In order to open the folding box 1, the lever 8 (FIG. 1) is pushed along the second, in particular short, side wall 3 of the folding box 1 inwards (in the direction of the box interior), although, as explained above, a design base on the reverse mirror image would also be possible. As a result, the pin 5, which is fixedly connected to the lever 8 in particular, is moved in a rotating motion. Provided at the first pin end 5*a*, as was the case with the embodiment described in connection with FIG. 3*c*, is a taper 11, i.e. the pin 5 is of a tapering design, which locates in the first side wall 2, i.e. the retaining element 4, and locks. This locking system is shaped so that it establishes a lock in the closed state, i.e. when the side walls 2, 3 of the folding box 1 are in the upright position. To this end, the retaining element 4 is provided with two oppositely lying shells 12 which accommodate the tapered pin end 5*a* of the pin 5 (FIG. 8). When the pin 5 is rotated, the lock is released so that the pin end 5*a*, which is of an oval shape in cross-section, can be moved out of engagement with the shells 12. As a result, the second side wall 3 can be folded inwards. As the second side wall 3 is folded into the retaining element 4, the leaf springs 9 (FIG. 1) again ensure that the lever 8 (FIG. 1) is returned to its initial position or non-operating position. As the side walls 2, 3 are closed, the pin end 5*a* is pressed into the flexible shells 12. The lever 8 therefore remains in its initial position. The folding box 1 is therefore locked again. As with the other embodiments, the pin 5 may be clipped into the spring orifices or bearing shell 6 (FIG. 5) of the reinforcing rib(s) 7 when the lock is being assembled.

In all variants of the invention, the pin 5 may be made from metal, for example. For example, the lever 8 and/or the leaf springs 9 may likewise be made from metal and welded onto the pin 5. However, it would also be conceivable for the lever 8 and/or the leaf springs 9 to be made from plastic and injected molded onto the pin 5, for example. Finally, it would also be possible for the pin 5, lever 8 and leaf springs 9 to be made as a single piece from metal or also from plastic. In the case of the latter variant, consideration may be given to inexpensive injection molded parts which are almost totally freely selectable in terms of shape. Any shape may be imparted to the pin ends 5*a* and 5*b* during the injection molding process already, but could also be produced by grinding, for example (such as flattening a wire that is circular in shape in the unprocessed state) or pressing. Finally, it would also be possible to use different materials for the pin 5 and its ends 5*a* and 5*b*. For example, pin ends 5*a* and 5*b* made from plastic may be fitted onto a pin 5 made from metal or alternatively pin ends 5*a* and 5*b* made from metal may be fitted onto a pin 5 made from plastic.

Although it is assumed in the drawings that the pin ends 5*a* and 5*b* extend out from both sides of the second side wall 3, other variants would naturally also be possible. For example, it would also be possible for only a first pin end 5*a* to extend out from the second side wall 3. In this case, the folding box 1 is merely locked at one side. It would also be conceivable for two pins 5 with a total of four pin ends to be provided on the second side wall 3. However, there are advantageously four points on the folding box 1 where locks are provided, namely on both sides of the two second side walls 3. This results in one lock per corner of the folding box 1.

For the sake of good order, finally, it should be pointed out that, in order to provide a clearer understanding of the structure of the folding box 1, it and its constituent parts are illustrated to a certain extent out of scale and/or on a larger scale and/or on a smaller scale.

The specific objective underlying the individual inventive solutions may be found in the description.

Above all, the individual embodiments illustrated in FIGS. 1 to 6 may be construed as independent solutions proposed by the invention. The associated objectives of the invention and the solutions may be found in the detailed descriptions of these drawings.

LIST OF REFERENCE NUMBERS

1 Folding box
2 First side wall
3 Second side wall
4 Retaining element
5 Pin
5*a* First pin end
5*b* Second pin end
6 Bearing shell
7 Reinforcing rib
8 Lever
9 Leaf spring
10 Guide gap
11 Taper
12 Shell

The invention claimed is:

1. Folding box, comprising:

a base, first and second side walls which, together with the base, form a box open at the top in the folded open state, at least one retaining element disposed on a first side wall, at least one pin mounted so as to be rotatable on a second side wall, wherein the at least one pin has a cross-section that is not circular on at least one pin end and the at least one pin end locks the first to the second side wall via the retaining element in a first rotational position and unlocks said side walls in a second rotational position, and wherein the at least one pin can be automatically rotated into the second rotational position as the second side wall is folded open.

2. Folding box according to claim 1, wherein the at least one pin end has a cross-section selected from the group comprising rectangular with rounded corners, S-shaped, oval, ellipsoid, hook-shaped or a flattened circular cross-section.

3. Folding box according to claim 1, wherein the at least one pin can be automatically rotated into the first rotational position with the aid of a spring.

4. Folding box according to claim 3, wherein the at least one pin can be automatically rotated into the first rotational position with the aid of the spring once the second side wall has assumed an end position.

5. Folding box according to claim 1, wherein the at least one pin can be rotated into the first and/or second rotational position via a handle.

* * * * *

UNITED STATES PATENT AND TRADEMARK OFFICE

CERTIFICATE OF CORRECTION

PATENT NO. : 8,550,278 B2
APPLICATION NO. : 13/138412
DATED : October 8, 2013
INVENTOR(S) : Gerhard Pittrich It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 82 days.

Signed and Sealed this
Fifteenth Day of September, 2015

Michelle K. Lee

Michelle K. Lee
*Director of the United States Patent and Trademark Office*